US008810150B2

(12) United States Patent
Kimura et al.

(10) Patent No.: US 8,810,150 B2
(45) Date of Patent: Aug. 19, 2014

(54) LAMP DRIVE DEVICE

(75) Inventors: Toshiro Kimura, Kyoto (JP); Hideki Soya, Shanghai (CN); Daijiro Kato, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 8 days.

(21) Appl. No.: 13/489,290

(22) Filed: Jun. 5, 2012

(65) Prior Publication Data

US 2012/0319589 A1 Dec. 20, 2012

(30) Foreign Application Priority Data

Jun. 15, 2011 (JP) ..... 2011-133244

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/295*** | (2006.01) |
| *H01J 13/48* | (2006.01) |
| *H01J 15/04* | (2006.01) |
| *H01J 17/36* | (2006.01) |
| *H05B 37/00* | (2006.01) |
| *H05B 39/00* | (2006.01) |
| *H05B 41/00* | (2006.01) |

(52) U.S. Cl.
CPC ..... *H05B 41/295* (2013.01)
USPC ..... 315/291; 315/326

(58) Field of Classification Search
None
See application file for complete search history.

(56) References Cited

FOREIGN PATENT DOCUMENTS

| | | | | |
|---|---|---|---|---|
| JP | 2004234924 A * | 8/2004 | ..... | H05B 41/24 |
| JP | 2005-209418 | 8/2005 | | |

* cited by examiner

*Primary Examiner* — Douglas W Owens
*Assistant Examiner* — Dedei K Hammond
(74) *Attorney, Agent, or Firm* — Bingham McCutchen LLP

(57) ABSTRACT

A lamp drive device L is provided that can both light a lamp and sustain a discharge by applying a trigger voltage while a direct current voltage is supplied from a power supply circuit to the electrodes of lamp before the start of discharge. The device includes a reference amount-of-change storage unit for storing a threshold value T for the amount of change in the electrode voltage before and after start of discharge, a difference calculation unit for calculating the difference (A−B) between the voltage monitor value B after the start of discharge and the voltage monitor value A before the start of discharge, and a lighting status determination unit for determining the lighting status by comparing the difference (A−B) and the threshold value T and making the determination based on the change in voltage before and after the discharge.

4 Claims, 2 Drawing Sheets

LAMP DRIVE DEVICE

FIELD OF THE INVENTION

The present invention relates to a lamp drive device that uses a constant current source to drive a lamp, and more specifically, to a lamp drive device used in a lamp in which the self-sustaining discharge voltage after lighting starts changes from the voltage applied to the electrode prior to the start of lighting. The lamp drive device of the present invention may be used, for example, as the drive device of a deuterium lamp used as the light source of a spectrophotometer, liquid chromatograph device and the like.

BACKGROUND ART

Analyzers such as spectrophotometers use deuterium lamps as light sources for detecting transmittance and absorbance of ultraviolet/visible light in the 180 to 400 nm wavelength band.

Deuterium lamps place a window made of UV glass or quartz glass that allows ultraviolet light to pass through a part of a glass bulb and are able to emit light in the ultraviolet/visible range from that window by applying the voltage of the drive device to electrodes formed within the bulb (i.e., across the cathode and anode) to produce and maintain the electrical discharge.

Deuterium lamps used in analyzers require stability in the amount of light emitted through the window in order to provide stable measurement data. Because the stability of the amount of emitted light depends on the stability of the drive current of the deuterium lamp, lamp drive devices use power supply circuits with a constant current source (Patent Literature 1).

FIG. 3 is a schematic block diagram of a spectrophotometer that uses a deuterium lamp drive device described in Patent Literature 1 as the lamp drive device.

Main power supply 3 supplies drive circuit 7 with a commercial 100 V (or 200 V) AC voltage. Drive circuit 7 comprises: a rectifier circuit 4, which transforms AC voltages to DC voltages; a deuterium lamp 1 (discharge tube); a constant current source 2, which supplies constant current to deuterium lamp 1 (during discharge); a heater power supply 6, which heats the cathode of deuterium lamp 1; and trigger voltage generator 5 (trigger power supply), which temporarily applies a pulsed trigger voltage (about 350 V) to start discharge.

With this lamp drive device, the cathode of deuterium lamp 1 is heated by heater power supply 6 so that it discharges thermions.

Then a DC voltage higher than the self-sustaining discharge voltage (about 80 V) required to maintain discharge is applied to the electrodes before the start of discharge by power supply circuit 7*a*, which comprises rectifier circuit 4 and constant current source 2. After discharge starts, a stable discharge is maintained by supplying a constant current from constant current source 2.

To start a discharge, a lighting instruction signal from a controller 9 (the controller of the computer that controls the entire spectrophotometer also serves as the lamp drive device controller) of the lamp drive device is used to apply pulsed trigger voltage (e.g., 350 V) from trigger voltage generator 5. This starts a discharge.

Then, a determination is made as to whether the lamp is lit by using a voltage monitor circuit 8 to measure the voltage applied to the electrodes of deuterium lamp 1 from power supply circuit 7*a* (rectifier circuit 4 and constant current source 2). This determination is made so that no measurement data is acquired in error with the lamp unlit should the lamp fail to light despite the application of the trigger voltage.

An example of the voltage monitor circuit 8 includes a voltage divider resistor for detecting electrode voltage and an AD converter to convert the voltage value measured by the voltage divider resistor into digital data, which is sent to controller 9.

The manner in which the voltage monitor circuit 8 determines whether or not the lamp is lit is described next. The voltages applied to the electrodes by trigger voltage generator 5 and heater power supply 6 are irrelevant to the lighting status determination and is not described here.

First, prior to the start of discharge, no current is flowing to deuterium lamp 1. The voltage monitor value A measured by voltage monitor circuit 8 when not discharging is the value determined by voltage $\alpha$ applied to the electrodes by power supply circuit 7*a* (rectifier circuit 4 and constant current source 2) and the error $\alpha$ in voltage monitor circuit 8, which measures the electrode voltage. "Error $\alpha$ in voltage monitor circuit 8" is produced by the fact that individual voltage monitor circuits 8 used in individual lamp drive devices can be different and not exactly identical. Voltage monitor value A is treated as including an error $\alpha$ within a set range defined by the specifications for each voltage monitor circuit 8 of each respective device.

Once discharge begins (after lighting), a constant current flows to the electrodes, and the self-sustaining discharge voltage for maintaining discharge is produced in the electrodes. The self-sustaining discharge voltage b required for flowing a constant current to the electrodes is a value unique to each deuterium lamp 1 (initially, about 80 V) and may increase with aging.

The voltage monitor value B measured by voltage monitor circuit 8 after discharge begins is the value determined by the self-sustaining discharge voltage b of deuterium lamp 1 and the error $\alpha$ in voltage monitor circuit 8.

Accordingly, the determination of the lighting status is made by determining whether the measurement by voltage monitor circuit 8 shows a voltage monitor value A (A is equal to the voltage value a that is applied when not discharging further increased or decreased by error $\alpha$ in the voltage monitor circuit) or voltage monitor value B (B is equal to the self-sustaining discharge voltage value b increased or decreased by error $\alpha$ in the voltage monitor circuit).

Traditionally, this determination has been made by selecting a threshold value S such that:

$$\text{Voltage monitor value } A > \text{Threshold value } S > \text{Voltage monitor value } B \quad (1)$$

The threshold value S was a value that was selected independently of the device used. A determination of lit or unlit was made by comparing the result of the measurement against the threshold value S and seeing whether it was greater than or less than the threshold value S.

PRIOR ART LITERATURE

Patent Literature

Patent Literature 1: Unexamined Patent Application Publication No. 2005-209418

SUMMARY OF THE INVENTION

Problem to be Solved by the Invention

As afore-described, voltage monitor circuit 8 is required for measuring the electrode voltage value of deuterium lamp 1. The error α of voltage monitor circuit 8 must also be considered in order to set a fixed threshold value S, which is independent of the particular device.

Specifically, a determination of lit or unlit must be possible even when error α works to the greatest disadvantage.

For that reason, the following condition must be met:

Minimum electrode voltage $\alpha(\alpha_{min})$ applied during non-discharge+Minimum error α ($\alpha_{min}$) of voltage monitor circuit>Threshold value S>Maximum electrode voltage b ($b_{max}$) applied after start of discharge+Maximum error $\alpha(\alpha_{max})$ of voltage monitor circuit (2)

The voltage difference before and after start of discharge must be made larger when accounting for error α of voltage monitor circuit 8 as compared to when it is ignored.

However, if a large voltage difference is set for before and after the start of discharge, the voltage difference is consumed as heat within drive circuit 7 (and particularly by the resistor and transistor devices within constant current circuit 2) apart from deuterium lamp 1.

For that reason, setting a large voltage difference for before and after the start of discharge produces the adverse effect of increased amount of heat generated by drive circuit 7, which increases costs by requiring the use of devices that can tolerate the heat that is generated, and in some cases, creates the need for the installation of cooling mechanisms to control the temperature changes.

The purpose of the present invention is therefore, above all, to provide a lamp drive device that can both accurately determine whether a lamp is lit while also being able to suppress, as much as possible, the generation of heat by the drive circuit after lighting due to the excessive potential difference.

To be examined next from a different standpoint is the problem that arises from the change in self-sustaining discharge voltage caused by aging. A specific example will be used in studying this problem.

Assume that, in a deuterium lamp drive device, the electrode voltage α that is applied when not discharging is 100 V and that the voltage monitor value A is theoretically 95-105 V, taking into consideration the error α of voltage monitor circuit 8 (α of approximately ±5 V).

Accordingly, the fixed threshold value S in the individual lamp drive devices is set another 5 V smaller than the projected minimum voltage monitor value A of 95 V, or 90 V. Assume that when two lamp drive devices are manufactured under these conditions, the first of the devices has a voltage monitor value A for electrode voltage when not discharging of 105 V, while the second of the devices uses 95 V.

Here, voltage monitor value B after the start of discharge is assumed to be less than 90 V (initially 85 V) for both the first and second devices.

In this case, both devices fulfill (2), and the lighting status can be accurately ascertained, but the first device has a big disadvantage since the threshold value S is set to the same fixed 90 V as the other device.

Since the first device has a voltage monitor value A for electrode voltage when not discharging of 105 V, the lighting status can be determined even if the voltage monitor value B after the start of discharge increases to nearly 100 V due to changes with aging.

However, the fixed threshold value S of 90 V is set for all devices. This threshold value S is set to 90 V out of consideration of the worst-case condition where the error in the voltage monitor circuit 8 works to the greatest disadvantage (in this case, when voltage monitor value A is 95 V). This means that, even with the first device, if the voltage monitor value B rises to 90 V, it would not be possible to determine the lighting status.

Thus, with the method of setting a fixed threshold value S envisioning the most disadvantageous case, even if the effects of aging can be reduced by using a more preferable threshold for making the lighting determination for a device such as the first device whose conditions are more advantageous, such lighting determination method was not used.

For that reason, it is the object of the present invention to provide a lamp drive device that can reduce the effects of changes due to aging compared to the previous art while avoiding malfunctions in lighting status determination.

Means of Solving the Problem

Generally, the electrode voltage changes from the voltage supplied from the power supply circuit when the lamp is not discharging to the self-sustaining discharge voltage b unique to the lamp simultaneous with the start of discharge. Before the start of discharge (when not discharging), a voltage α greater than the self-sustaining discharge voltage b is applied to the electrode. This means that when discharging starts, the potential difference of the electrode voltage changes by the difference (α−b). For that reason, that change (the amount of the difference) is used to identify the discharging state.

To explain, the lamp drive device according to the present invention comprises: a lamp; a constant current source; a power supply circuit for supplying a direct current voltage to the electrodes of the lamp necessary for sustaining discharge; a trigger voltage generator for applying a trigger voltage to the electrodes of the lamp for starting discharge; and a voltage monitor circuit for measuring the electrode voltage of the lamp; wherein the lamp is lit and discharging is sustained by applying a trigger voltage while supplying a direct current voltage from the power supply circuit to the electrodes of the lamp before the start of discharge; and further comprising: a reference amount-of-change storage unit for storing a threshold value T for the amount of change in electrode voltage before the start of discharge and after the start of discharge; an electrode voltage value storage unit for storing a monitor value A of the electrode voltage that is measured before the start of discharge; a difference calculation unit for calculating the difference (A−B) between the monitor value B of the electrode voltage measured after the start of discharge and the monitor value A of the electrode voltage before the start of discharge; and a lighting status determination unit for determining the lighting status by comparing the difference (A−B) and the threshold value T.

Effects of the Invention

The present invention calculates the difference (A−B) between electrode voltage monitor value B measured after the start of discharge and electrode voltage monitor value A before the start of discharge and determines the lighting status by comparing the difference to a threshold value T, stored in advance, of the amount of change in electrode voltages before the start of discharge and after the start of discharge.

By calculating the difference between monitor value A and monitor value B, error α arising in the voltage monitor circuit is canceled out, allowing the threshold value T used for determination of lighting status to be set without being affected by the effects of the error α. As a result, threshold value T, which serves as the reference for the potential difference between before the start of discharge and after the start of discharge, can be made smaller to the extent that a malfunction is not caused in determining the lighting status. This allows the minimization of the generation of heat after the start of discharge created by the excessive potential difference.

Also, from the perspective of the change in self-sustaining discharge voltage caused by aging, the lighting determination is based, not on a fixed threshold value S as the reference, but on the amount of change (threshold value T) from the device's voltage monitor value A for each individual device. This means that with devices where the error in the voltage monitor circuit works beneficially with regard to aging-related changes, the service life of the device until lighting determination becomes impossible is extended since the device is more resistant to fluctuations in aging-related changes.

MODES FOR PRACTICING THE INVENTION

Figure 1:
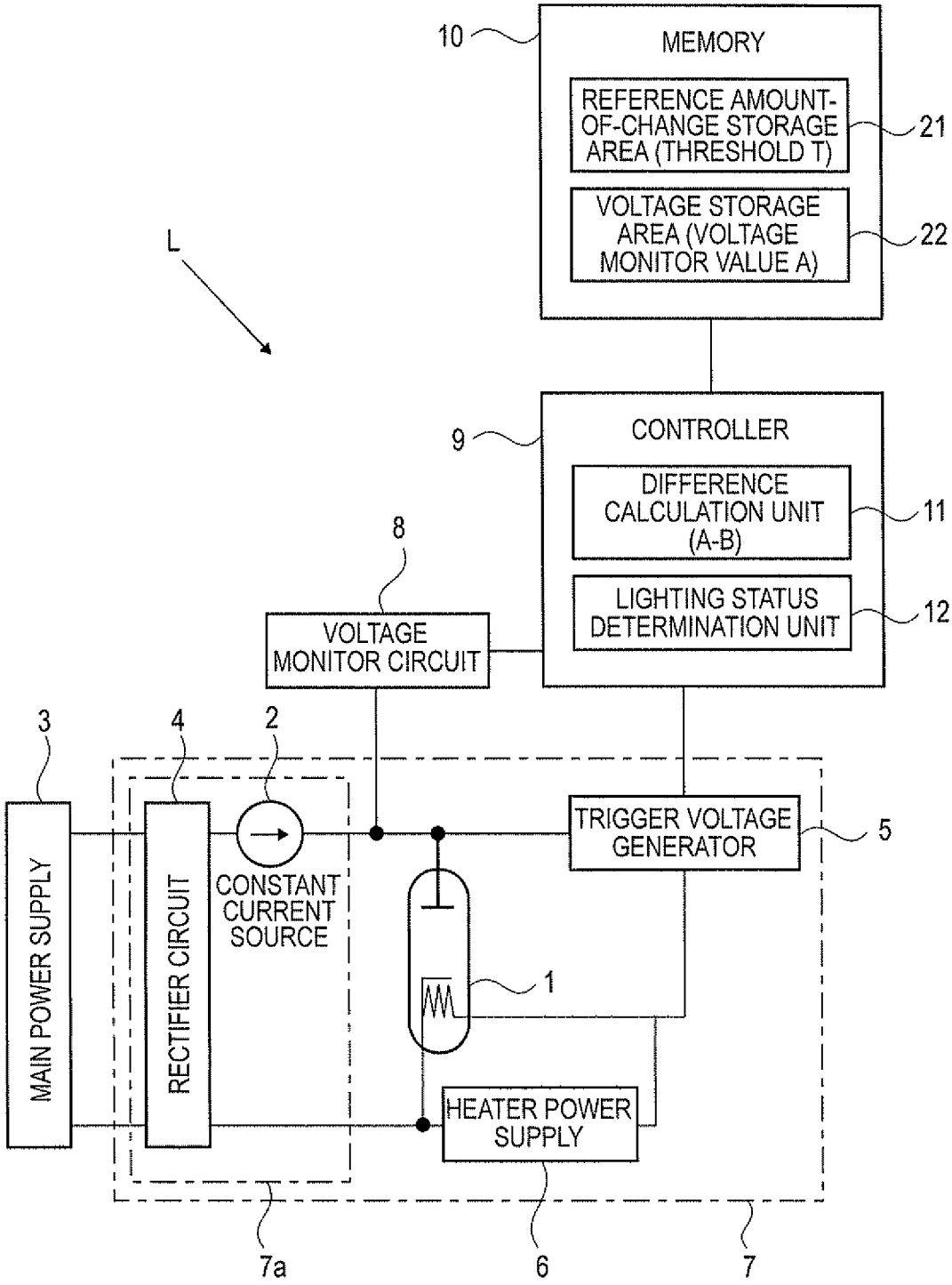
FIG. 1 is a block diagram showing the configuration of a lamp drive device that is one embodiment of the present invention.

The lamp drive device according to the present invention is described next with reference to figures. FIG. 1 is a block diagram of a lamp drive device L for a spectrophotometer that is one mode of practicing the present invention.

Figure 3:
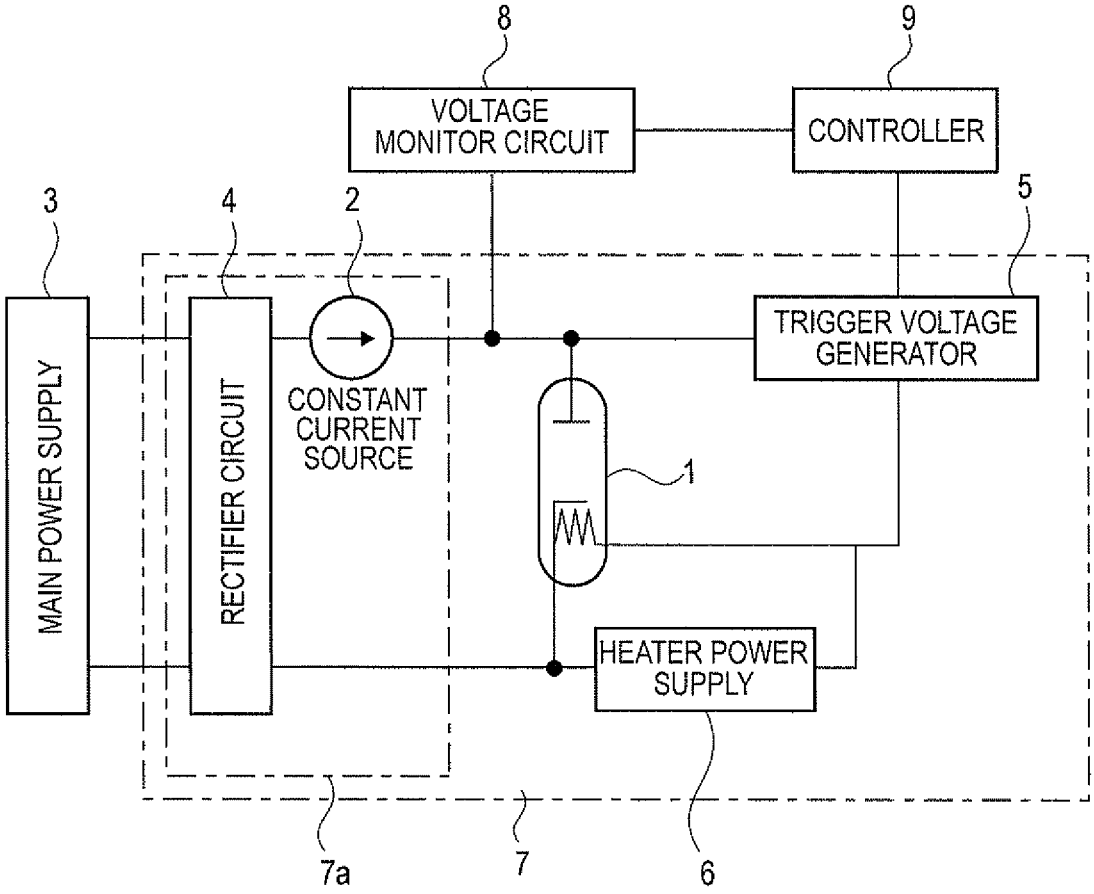
FIG. 3 is a block diagram showing the configuration of a previous lamp drive device.

In the figure, deuterium lamp 1, constant current source 2, main power supply 3, rectifier circuit 4, trigger voltage generator 5, heater power supply 6, drive circuit 7, power supply circuit 7*a*, and voltage monitor circuit 8 are the same as those used in FIG. 3 and explained in the context of a previous device. Accordingly, they are identified by the same reference numbers in the figure, and their explanation is omitted.

Lamp drive device L of the present invention is equipped with a controller 9 comprising a computer. This controller 9 controls the entire spectrophotometer including the lighting status determination for the lamp drive device.

To explain in terms of functional blocks, the processing means in controller 9 that relate to lighting status determination include difference calculation unit 11 and lighting status determination unit 12.

The memory 10 installed in controller 9 is equipped with reference amount-of-change storage area 21, which stores the threshold value T that relate to the amount of change of the electrode voltage before and after the start of discharge, and voltage storage area 22, which stores the voltage monitor value A from voltage monitor circuit 8 for the electrode voltage before the start of discharge.

Threshold value T stored in reference amount-of-change storage area 21 is the threshold for the amount of voltage change to be used as a reference in determining whether the lamp is lit or not. Increasing the threshold value T increases the precision of lighting status determination but also increases the surplus voltage that is created after the start of discharge and consequently the amount of heat that is generated. Hence, the threshold value T is set to strike a balance between increased accuracy of lighting status determination and suppression of the amount of heat that is generated. The accuracy of the determination is assessed in terms of the stability of voltage prior to discharge (e.g., the amount of voltage ripple).

Voltage storage area 22 stores the voltage monitor value A from voltage monitor circuit 8 for the electrode voltage before the start of discharge. This value is stored for calculating the difference with the voltage monitor value B immediately after the start of discharge. It is also possible to store the electrode voltage monitor value B after the start of discharge so that the difference can be calculated at any time.

Difference calculation unit 11 calculates the difference (A−B) between monitor value A of the electrode voltage before the start of discharge and monitor value B of the electrode voltage measured after the start of discharge.

Lighting status determination unit 12 compares the difference (A−B) calculated by difference calculation unit 11 to threshold value T. If the difference (A−B) is greater than threshold value T, the lamp is considered lit; if it is not, the lamp is considered unlit.

Figure 2:
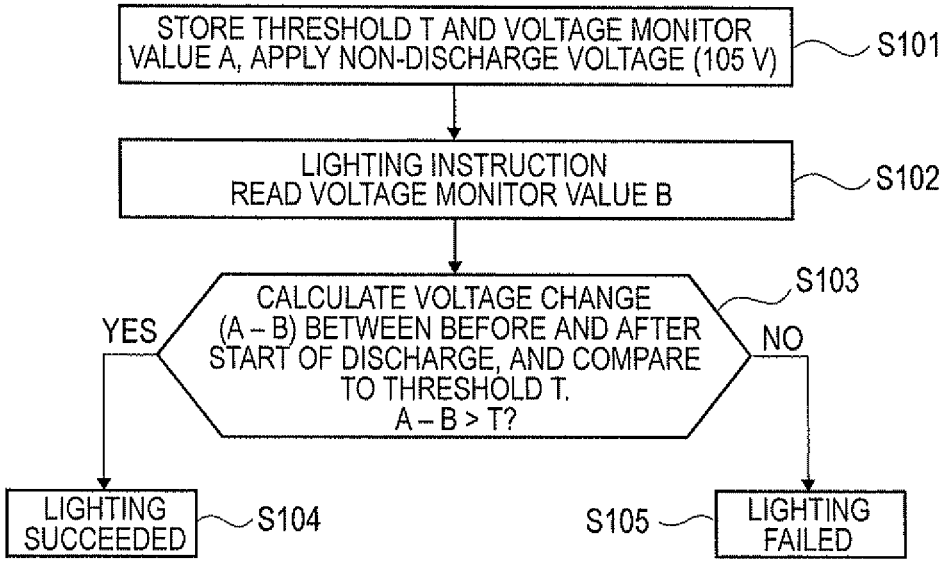
FIG. 2 is a flow chart showing the operational flow of the lamp drive device of FIG. 1.

The operation of lighting status determination using lamp drive device L is explained next. FIG. 2 is a flow chart showing the operational flow using lamp drive device L according to the present invention.

It is assumed that the specifications call for deuterium lamp 1 to use a self-sustaining discharge voltage of 80 V±20 V and voltage circuit 8 to have error α of ±10 V.

Threshold value T to be used as the lighting status determination reference and voltage monitor value A for the electrode voltage before the start of discharge are stored in advance in memory 10 (S101). Threshold value T is set to strike a balance between determination precision and suppression of heat generation. As an example, in this embodiment, the threshold value T is set to 5 V and is stored in reference amount-of-change storage area 21.

Also, power supply circuit 7*a* is set to apply a electrode voltage α of 105 V when not discharging even for a lamp (100 V) with the highest self-sustaining discharge voltage. This is done so that the lighting status can be determined even when the threshold value T is set to 5 V. It is possible to set a voltage of higher than 105 V, but the higher the voltage, the greater the heat that is generated. On the other hand, however, setting a higher voltage makes it more resistant to the effects of changes due to aging. Because of the effects of the error (±10 V), voltage monitor value A becomes 95 to 115 V. This monitor value A is stored in voltage storage area 22.

Next, controller 9 issues a lighting instruction (S102). After the lighting instruction is received, heater power supply 6 and trigger voltage generator 5 become activated, and discharge begins. Voltage monitor value B is then measured immediately after the start of discharge. Voltage monitor value B may be stored in memory at this time.

Next, the change in voltage before and after the start of discharge (voltage monitor value A−voltage monitor value B) is calculated and compared to threshold value T (S103).

If the difference (A−B) is greater than threshold value T, the lamp is determined to be lit (S104); if not, it is determined to be unlit (S105).

By using this determination method, because the effects of the error included in voltage monitor circuit 8 are the same for voltage monitor value A and voltage monitor value B, the error is cancelled out when the difference is calculated. Accordingly, unlike the case where a fixed threshold value S is used as a reference in making the lighting status determination, there is no longer a need to consider the error in the voltage monitor circuit 8 when setting the voltage to be applied when not discharging.

Comparative Example

As an example, with the previous determination that used threshold value 5, the threshold value S was set so that an electrode voltage α of 115 V was applied when not discharging. This is because a maximum error of 10 V for the voltage monitor circuit was added to the maximum self-sustaining discharge voltage of 100 V and an additional margin of 5 V was provided.

In other words, while, with the afore-described present invention, the electrode voltage α that is applied when not discharging is 105 V, an extra potential difference equivalent to the maximum error of 10 V for the voltage monitor circuit was applied in the previous case.

INDUSTRIAL APPLICABILITY

The present invention can be used in the lamp drive device of spectrophotometers and the like.

DESCRIPTION OF THE NUMERICAL REFERENCES

1. Lamp
2. Constant current source
3. Main power supply
4. Rectifier circuit
5. Trigger voltage generator
6. Heater power supply
7. Drive circuit
7*a*. Power supply circuit
8. Voltage monitor circuit
9. Controller
10. Memory
11. Difference calculation unit
12. Lighting status determination unit
21. Reference amount-of-change storage area (threshold T)
22. Voltage storage area (voltage monitor value A)
L. Lamp drive device

What is claimed is:

1. A lamp drive device comprising:
a lamp;
a constant current source;
a power supply circuit for supplying a direct current voltage to the electrodes of said lamp necessary for sustaining discharge;
a trigger voltage generator for applying a trigger voltage to the electrodes of said lamp to start a discharge; and
a voltage monitor circuit for measuring the electrode voltage of said lamp;
wherein said lamp is lit and discharge is sustained by applying a trigger voltage while supplying a direct current voltage from said power supply circuit to the electrodes of said lamp before the start of discharge; and further comprising:
a reference amount-of-change storage unit for storing a threshold value (T) for the amount of change in electrode voltage before the start of discharge and after the start of discharge;
an electrode voltage value storage unit for storing a monitor value (A) of the electrode voltage that is measured before the start of discharge;
a difference calculation unit for calculating the difference (A−B) between the monitor value (B) of the electrode voltage measured after the start of discharge and the monitor value (A) of the electrode voltage before the start of discharge; and
a lighting status determination unit for determining the lighting status by comparing said difference (A−B) and said threshold value (T).

2. The lamp drive device of claim 1, wherein the electrode voltage value storage unit also stores the monitor value (B) of the electrode voltage that is measured after the start of discharge.

3. A lamp drive device comprising:
a lamp;
a constant current source;
a power supply circuit for supplying a direct current voltage to the electrodes of said lamp necessary for sustaining discharge;
a trigger voltage generator for applying a trigger voltage to the electrodes of said lamp to start a discharge,
a voltage monitor circuit for measuring the electrode voltage of said lamp;
wherein said lamp is lit and discharge is sustained by applying a trigger voltage while supplying a direct current voltage from said power supply circuit to the electrodes of said lamp before the start of discharge;
a reference amount-of-change storage unit for storing a threshold value (T) for the amount of change in electrode voltage before the start of discharge and after the start of discharge;
an electrode voltage value storage unit for storing a monitor value (A) of the electrode voltage that is measured before the start of discharge and for storing a monitor value (B) of the electrode voltage that is measured after the start of discharge;
a difference calculation unit for calculating the difference (A−B) between the monitor value (B) of the electrode voltage measured after the start of discharge and the monitor value (A) of the electrode voltage before the start of discharge; and
a lighting status determination unit for determining the lighting status by comparing said difference (A−B) and said threshold value (T).

4. A lamp drive device comprising:
a lamp;
a constant current source;
a power supply circuit for supplying a direct current voltage to the electrodes of said lamp necessary for sustaining discharge;
a trigger voltage generator for applying a trigger voltage to the electrodes of said lamp to start a discharge,
a voltage monitor circuit for measuring the electrode voltage of said lamp before the discharge and after the discharge;
wherein said lamp is lit and discharge is sustained by applying a trigger voltage while supplying a direct current voltage from said power supply circuit to the electrodes of said lamp before the start of discharge;
a reference amount-of-change storage unit for storing a threshold value (T) for the amount of change in electrode voltage before the start of discharge and after the start of discharge;
an electrode voltage value storage unit for storing a monitor value (A) of the electrode voltage that is measured before the start of discharge and for storing a monitor value (B) of the electrode voltage that is measured after the start of discharge;
a difference calculation unit for calculating the difference (A−B) between the monitor value (B) of the electrode voltage measured after the start of discharge and the monitor value (A) of the electrode voltage before the start of discharge; and a lighting status determination unit for determining the lighting status by comparing said difference (A−B) and said threshold value (T).

* * * * *